US009145799B2

(12) United States Patent
Wigsten et al.

(10) Patent No.: US 9,145,799 B2
(45) Date of Patent: Sep. 29, 2015

(54) ADDITIONAL SPRING AND FOLLOWER MECHANISM BUILT INTO VALVE COVER OR BEARING BRIDGE

(75) Inventors: Mark M. Wigsten, Lansing, NY (US); Philip Mott, Dryden, NY (US); Christopher J. Pluta, Ithaca, NY (US)

(73) Assignee: BORGWARNER INC., Auburn Hills, MI (US)

( * ) Notice: Subject to any disclaimer, the term of this patent is extended or adjusted under 35 U.S.C. 154(b) by 79 days.

(21) Appl. No.: 13/878,452

(22) PCT Filed: Oct. 18, 2011

(86) PCT No.: PCT/US2011/056644

§ 371 (c)(1), (2), (4) Date: Apr. 9, 2013

(87) PCT Pub. No.: WO2012/054434

PCT Pub. Date: Apr. 26, 2012

(65) Prior Publication Data

US 2013/0192550 A1 Aug. 1, 2013

Related U.S. Application Data

(60) Provisional application No. 61/455,514, filed on Oct. 21, 2010.

(51) Int. Cl.

| | |
|---|---|
| ***F01L 1/34*** | (2006.01) |
| ***F01L 1/344*** | (2006.01) |
| ***F01L 1/46*** | (2006.01) |

(52) U.S. Cl.

CPC ..... *F01L 1/34409* (2013.01); *F01L 1/3442* (2013.01); *F01L 1/462* (2013.01)

(58) Field of Classification Search

CPC .. F01L 2001/0478; F01L 1/462; F01L 1/3442

USPC ..... 123/90.15, 90.17, 90.18, 90.44, 90.38, 123/90.12

See application file for complete search history.

(56) References Cited

U.S. PATENT DOCUMENTS

| | | | | | |
|---|---|---|---|---|---|
| 4,887,562 | A | * | 12/1989 | Wakeman | 123/90.16 |
| RE33,411 | E | * | 10/1990 | Inoue et al. | 123/90.44 |
| 5,040,500 | A | | 8/1991 | Reece | |
| 5,107,805 | A | | 4/1992 | Butterfield et al. | |
| 5,287,830 | A | * | 2/1994 | Dopson et al. | 123/90.16 |
| 5,435,276 | A | * | 7/1995 | Nakamura et al. | 123/90.16 |
| 6,978,749 | B2 | | 12/2005 | Simpson | |

(Continued)

FOREIGN PATENT DOCUMENTS

| | | |
|---|---|---|
| JP | 06-173617 | 6/1994 |
| JP | 07-102914 | 4/1995 |

(Continued)

*Primary Examiner* — Thomas Denion
*Assistant Examiner* — Ngoc T Nguyen
(74) *Attorney, Agent, or Firm* — Warn Partners, P.C.

(57) ABSTRACT

A torque pulsated variable cam timing camshaft arrangement for a reciprocating piston, internal combustion engine is provided. The arrangement includes a sprocket. A torque pulsated phaser unit is operatively associated with the sprocket. A camshaft is operatively associated with the sprocket and the camshaft torsionally powers the phaser unit. The camshaft has a cam lobe engaged with a first cam follower for controlling a position of a spring biased valve. A spring biased second cam follower is engaged with the cam lobe providing a torsional input to the camshaft.

15 Claims, 4 Drawing Sheets

(56) References Cited

U.S. PATENT DOCUMENTS

| | | | | |
|---|---|---|---|---|
| 2008/0196681 | A1* | 8/2008 | Lancefield et al. | 123/90.17 |
| 2010/0175652 | A1* | 7/2010 | Schoeneberg et al. | 123/90.21 |

FOREIGN PATENT DOCUMENTS

| | | |
|---|---|---|
| JP | 10-141017 | 5/1998 |
| JP | 2010-138860 | 6/2010 |

* cited by examiner

ADDITIONAL SPRING AND FOLLOWER MECHANISM BUILT INTO VALVE COVER OR BEARING BRIDGE

CROSS-REFERENCE TO RELATED APPLICATION

This application claims the benefit of U.S. Provisional Application No. 61/455,514, filed Oct. 21, 2010.

FIELD OF THE INVENTION

The field of present invention is that of camshaft arrangements which provide variable camshaft timing which is powered by a camshaft powered torque actuated phaser.

BACKGROUND OF THE INVENTION

Variable camshaft timing for reciprocating piston internal combustion engines has been brought forth to modify the emissions characteristics of engines. One type of variable camshaft timing (VCT) camshaft arrangement is shown in commonly assigned U.S. Pat. No. 5,002,023 Butterfield et al. Butterfield et al. provides a camshaft timing arrangement wherein pressurized fluid used in powering a phasing of the intake camshaft is powered by torsional differences experienced by the engine's exhaust camshaft. Commonly assigned U.S. Pat. No. 5,107,805 Butterfield et al. and U.S. Pat. No. 6,978,749 Simpson described methods to increase the magnitude of torque pulsations in the camshaft to provide a camshaft arrangement which is more advantageous to take advantage of the torque pulsated phaser VCT system previously described in U.S. Pat. No. 5,002,023. It is desirable in some applications to provide a camshaft arrangement with augmented magnitude of torque pulsation without the requirement of adding additional cams to the camshaft thereby possibly increasing the camshaft's ultimate length. This is particularly relevant when attempting to use a variable camshaft timing with a torque pulsated phaser wherein the camshaft is being utilized on a straight 6 cylinder type internal combustion engine in a transverse mounted front wheel drive vehicle.

SUMMARY OF THE INVENTION

To make manifest the above noted desire, a revelation of the present invention is brought forth. In a preferred embodiment the present invention brings forth a torque pulsated variable cam timing camshaft arrangement for a reciprocating piston, internal combustion engine. The arrangement includes a sprocket. A torque pulsated phaser unit is operatively associated with the sprocket. A camshaft is operatively associated with the sprocket and the camshaft torsionally powers a phaser unit. The camshaft has a cam lobe engaged with a first cam follower for controlling a position of a spring biased valve. A second spring biased cam follower is engaged with the cam lobe providing a torsional input to the camshaft.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
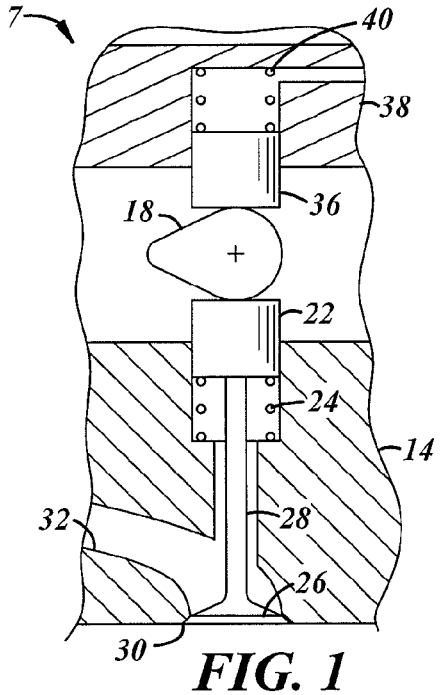
FIG. 1 is a schematic sectional view of a preferred embodiment of the present invention.
Figure 4:
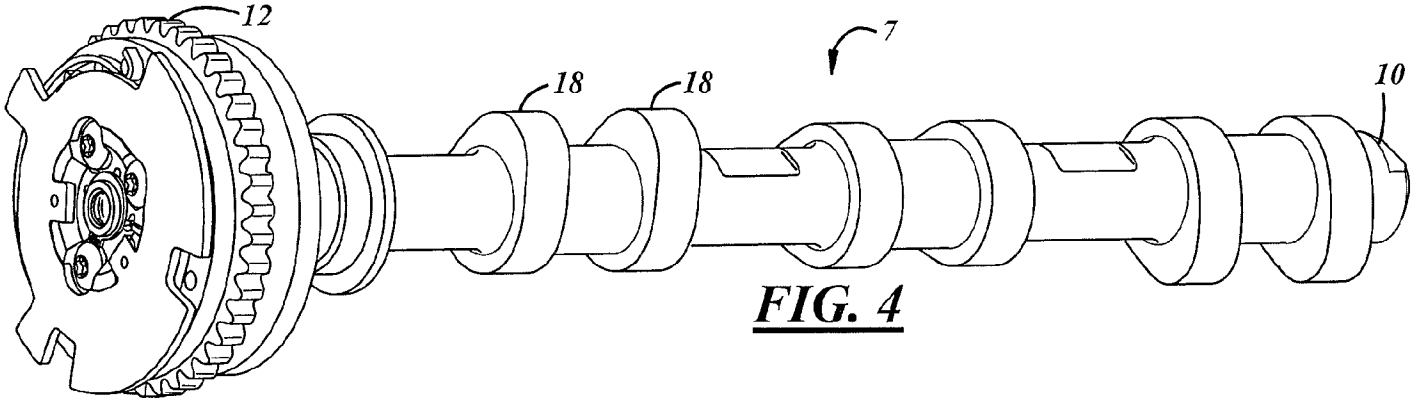
FIG. 4 is a perspective of an embodiment of the present invention of a camshaft which can be utilized in the embodiments of the invention shown in prior FIGS. 1-3.
Figure 5:
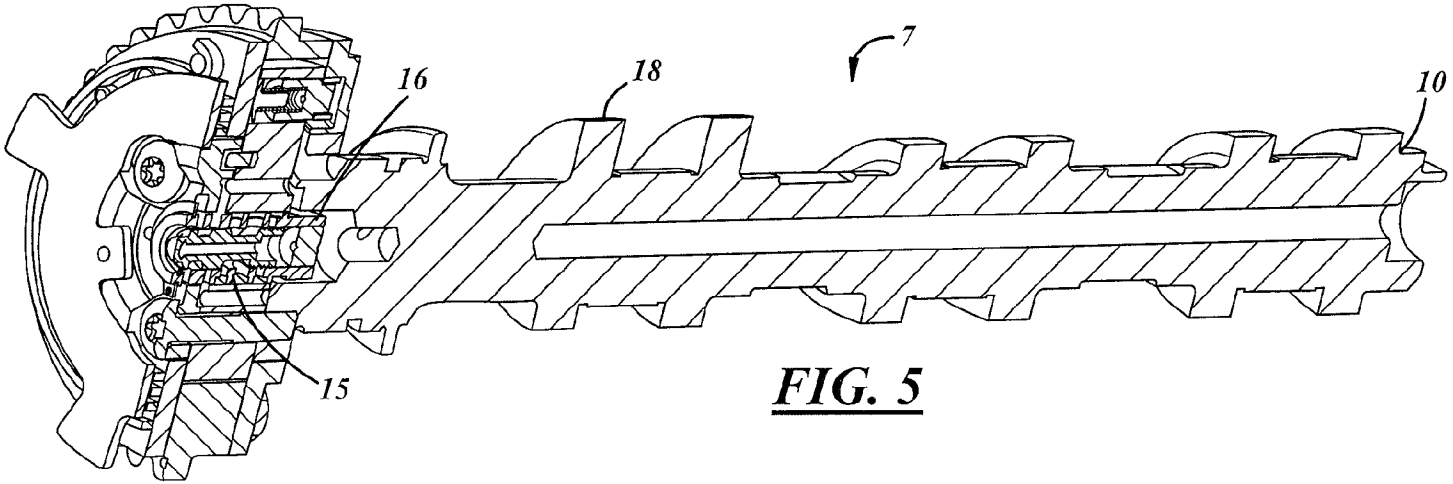
FIG. 5 is an axial sectional view of the camshaft shown in FIG. 4.

Referring to FIGS. 1, 4 and 5, a reciprocating piston internal combustion engine torque pulsated variable cam timing camshaft arrangement 7 according to the present invention has a camshaft 10. Connected with and operatively associated with the camshaft 10 is a sprocket 12. The sprocket 12 may be powered by a flexible tensioned force transfer member such as a belt or chain (not shown) that is engaged with a sprocket (not shown) connected with a crankshaft of an internal combustion engine 14. The sprocket 12 is connected with a torque pulsated camshaft phaser unit 15 which is inclusive of a spool valve 16. The spool valve 16 is controlled by an electronic control unit (not shown) to allow amplitude spikes in the torque experienced by the camshaft 12 to power the phaser unit 15 and thereby allow the camshaft 10 to be angularly adjustable with respect to the sprocket 12. A greater understanding of the various phaser units and the attributes of the phaser units utilized to achieve the variable angular displacement of the camshaft with respect to the sprocket can be gained from a review of commonly assigned U.S. Pat. No. 5,002,023; U.S. Pat. No. 7,699,031; U.S. Pat. No. 7,318,401; U.S. Pat. No. 7,231,896; U.S. Pat. No. 7,214,153 and U.S. Published Patent Application 2010/0170458.

Figure 2:
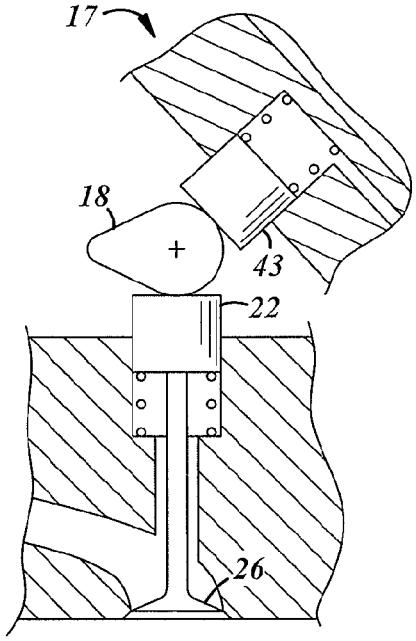
FIG. 2 is a view similar to that of FIG. 1 of an alternate preferred embodiment of the present invention.
Figure 3:
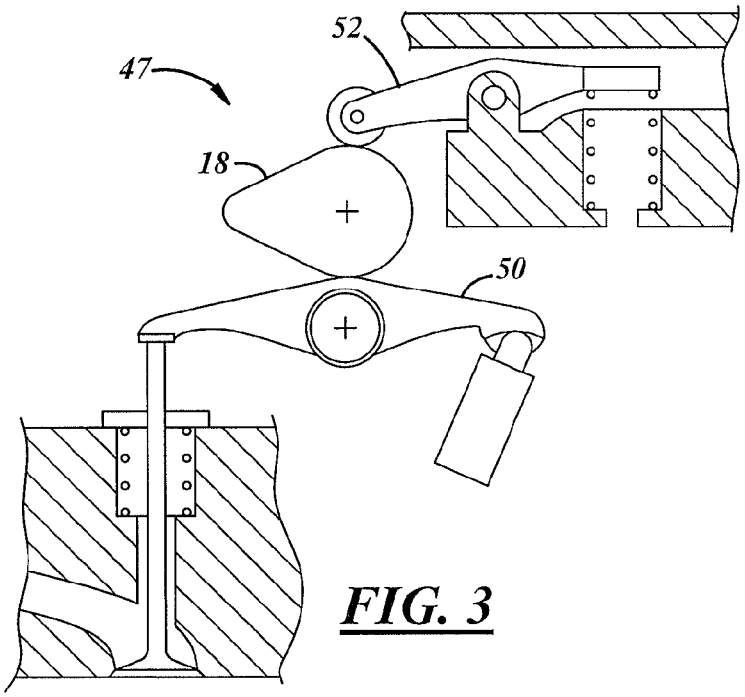
FIG. 3 is a view similar to that of FIG. 1 of still yet another alternate preferred embodiment of the present invention.

Connected on the camshaft 10 are a series of lobes 18. The lobes 18 come in generally three sets of two lobes which are positioned approximately 120 degrees from one another and as shown the camshaft 10 will typically be utilized for dual intake or dual exhaust valves in a V6 engine. The cam lobes 18 are engaged with a first cam follower 22. The cam follower 22 is biased by a spring 24 to control inlet or exhaust valve 26 via its stem 28. The valve 26 opens or closes an opening 30 to the interior of the cylinder which is in turn connected with an intake or exhaust passage 32. Although the torque experienced by the camshaft 10 does have amplitude pulsations in many instances due to the uniform nature of the angular distance between the lobes, the camshaft torsional vibrations may not experience an amplitude that is optimal for powering the phaser unit 16. Prior to the current invention to provide the additional torsional input a supplemental cam lobe having a configuration similar to or different than that of lobe 18 was added to the camshaft. This typically required an increased length of the camshaft which in some configurations is undesirable. Such a solution is shown in the aforementioned U.S. Pat. No. 5,107,805 and U.S. Pat. No. 6,978,749 (additional lobes are added to the camshaft.) To eliminate a need for an additional cam lobe, the present invention adds a secondary cam follower 36. The secondary cam follower 36 is typically biased by a contacting spring 40. The secondary cam follower 36 is typically connected with a bearing bridge or valve cover 38. As shown in FIG. 1 cam followers 22 and 36 are translationally aligned with each other, that is they translate along axis that are generally aligned with each other. In a camshaft arrangement 17 shown in FIG. 2 with similar parts given similar numbers a secondary cam follower 43 translates along an axis at an angle with respect to the translational axis of the cam follower 22. In FIG. 3 with similar items being given similar reference numerals a camshaft arrangement 47 is shown having a primary rocker type camshaft follower 50 and a secondary rocker type camshaft follower 52. Additionally in other applications of embodiments 7, 17 and 47 a plurality of secondary cam followers may be utilized.

Figure 6:
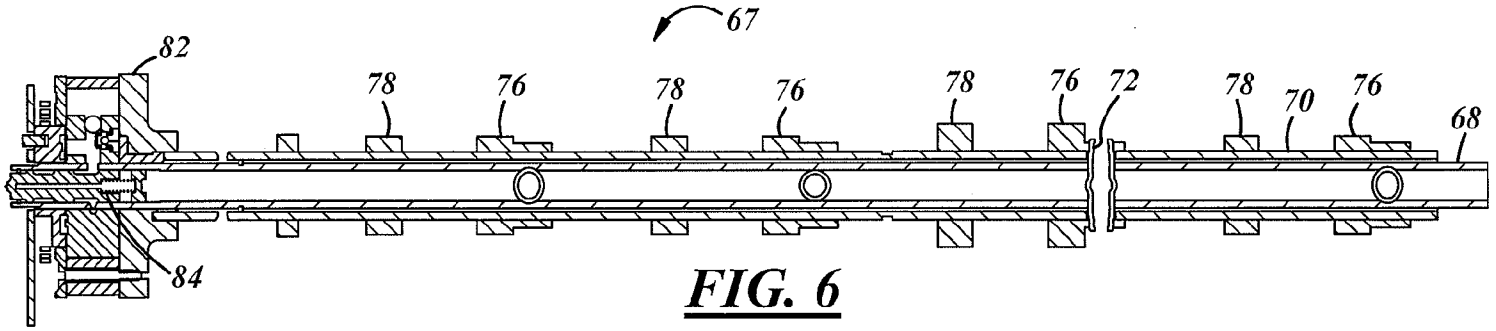
FIG. 6 is a sectional view of a concentric camshaft arrangement according to the present invention which controls both the intake and exhaust valves.
Figure 7:
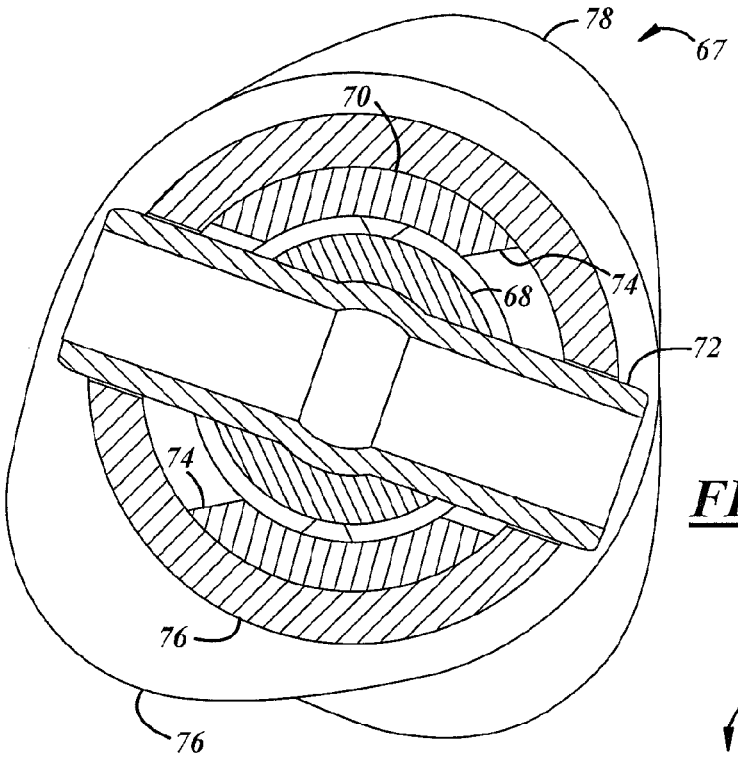
FIG. 7 is a transverse sectional view of the camshaft arrangement shown in FIG. 6.

Referring to FIGS. 6 and 7 a camshaft arrangement 67 has concentric inner and outer camshafts 68 and 70. Fixably connected with inner camshaft 68 is a pin 72. Pin 72 extends through slot 74 provided in the outer camshaft 70. Pin 72 is also fixably connected with intake cam lobe 76. Intake cam lobes 76 are rotatively connected upon the outer diameter of the outer camshaft 70. Torsionally fixably connected on the outer camshaft 70 are exhaust cam lobes 78. The outer camshaft 70 is torsionally fixed with respect to a sprocket 82. A phaser unit similar to that described in aforementioned U.S. Patent Publication 2010/01070458 allows the inner shaft 68 to have angular displacement with respect to the sprocket 82. Accordingly, timing of the cylinders in which the camshaft arrangement 67 is utilized upon, can allow variable timing for the intake valves in respect to the exhaust valve timing. A more detailed explanation of the variable valve timing attributes which can be utilized is found in a review of U.S. Patent Publication No. 2010/0170458. The camshaft arrangement 67 will typically provide the secondary follower to be in contact with one of the intake cam lobes 76. The camshaft arrangement 67 is typically utilized in four cylinder engines or in one half of a V8 engine. In another embodiment the camshaft arrangement 67 will control just the intake or just the exhaust valves. Examples are for engines with four valves per cylinder with the camshaft arrangement having the inner shaft for half of the intake (or exhaust valves) and the outer shaft controlling the other intake (or exhaust valves).

Figure 8:
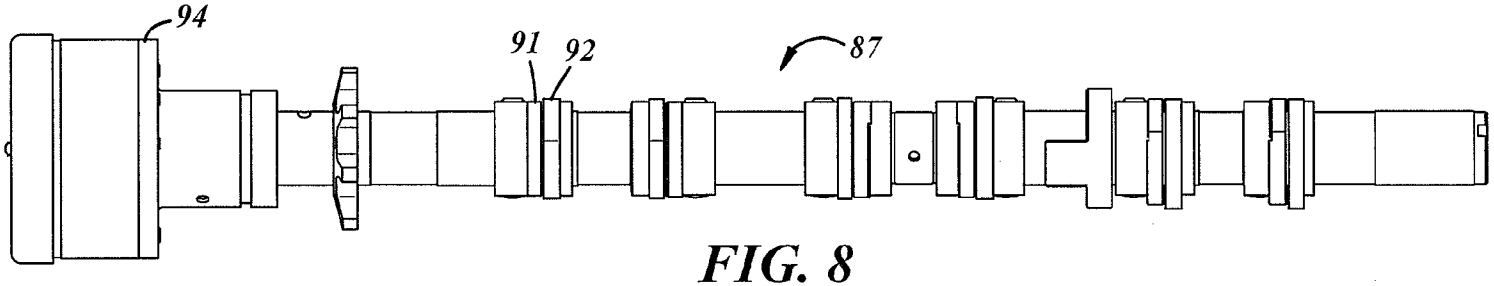
FIG. 8 is a side elevational view of a camshaft arrangement according to the present invention having separate lobes for both opening and closing a common valve.
Figure 9:
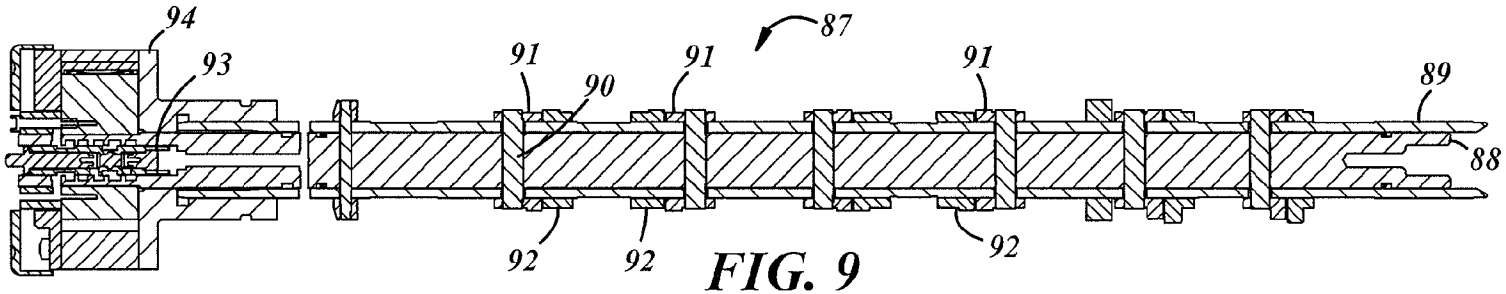
FIG. 9 is an axial cross-sectional view of the camshaft arrangement shown in FIG. 8.
Figure 10:
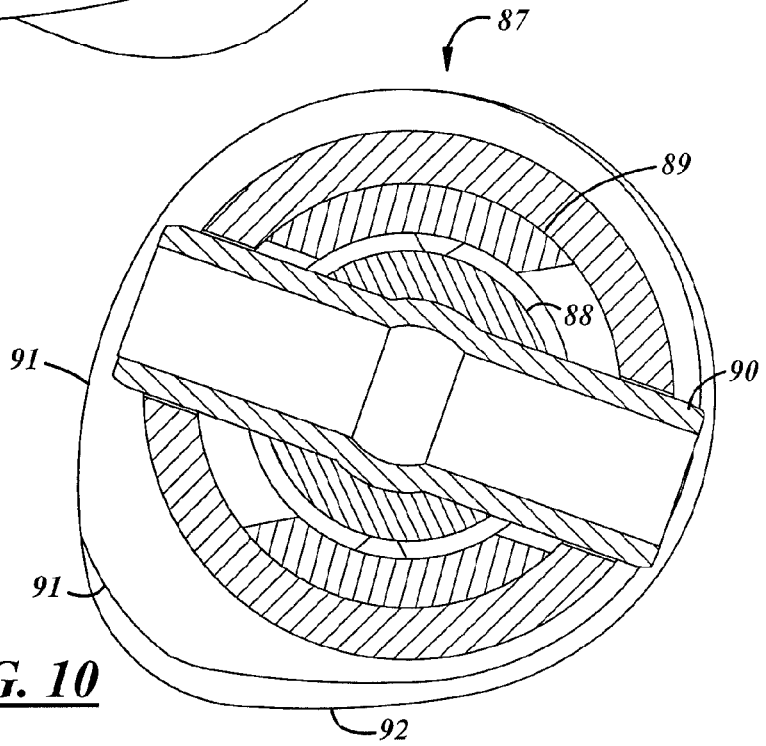
FIG. 10 is a transverse cross-sectional view of the camshaft shown in FIG. 8.

FIGS. 8, 9 and 10 illustrate a camshaft arrangement similar to camshaft arrangement 67 previously described. Camshaft arrangement 87 has concentric inner camshaft 88 and outer camshaft 89. Inner camshaft 88 via pins 90 is connected with cam lobes 91. Cam lobes 91 are rotative on outer camshaft 89. Cam lobes 92 are fixably connected upon the outer camshaft 89 which is in turn torsionally fixably connected with the sprocket 94. Again, a phaser unit 93 similar in function to that of phaser unit 84 allows the inner camshaft 88 to have angular adjustable movement with respect to the sprocket 94. Camshaft arrangement 88 is significant in that it has separate cams to raise a given cam follower and to lower the same cam follower. Accordingly, in most situations, a secondary follower will be engaged with a cam lobe 91. Although cam lobes 91 only experience torsional input with a first follower in a single angular direction, by the utilization of the secondary follower as shown in FIG. 1, 2 or 3, a torsional input is made into the camshaft provided by the inner shaft 88 which enables the phaser unit 93 to be powered by the camshaft.

Although not shown, the current invention can be utilized in camshaft arrangements as shown in Butterfield et al. U.S. Pat. No. 5,002,023 wherein the camshaft upon which phaser unit is torsionally fixed to is controlling of the exhaust valves and wherein there is a secondary sprocket which is phased by the phaser. The secondary sprocket, through an auxiliary belt, powers the intake camshaft.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A reciprocating piston internal combustion engine torque pulse VCT camshaft arrangement comprising:

a sprocket;

a cam torque actuated phaser connected with said sprocket;

a camshaft connected with said sprocket and torsionally powering said cam torque actuated phaser;

a cam lobe connected with said camshaft being engaged with a first cam follower for controlling a position of a valve biased by a first spring; and a second cam follower biased by a contacting spring separate from said first spring biasing said valve, said second cam follower being engaged with said cam lobe for imparting a torsional input to said camshaft.

2. A camshaft arrangement as described in claim 1 wherein said first cam follower is a rocker arm type cam follower.

3. A camshaft arrangement as described in claim 1 wherein said second cam follower is a rocker type cam follower.

4. A camshaft arrangement as described in claim 1 wherein said second cam follower is connected on a bearing bridge.

5. A camshaft arrangement as described in claim 1 wherein said second cam follower is connected on a valve cover.

6. A camshaft arrangement as described in claim 1 wherein said first and second cam followers translate along an axis aligned with one another.

7. A camshaft arrangement as described in claim 1 wherein said first and second cam followers translate along an axis at an angle with respect to one another.

8. A camshaft arrangement as described in claim 1 wherein said camshaft is a concentric camshaft arrangement having a first camshaft angularly adjustable with respect to said sprocket and a second concentric camshaft.

9. A camshaft arrangement as described in claim 8 wherein said first camshaft is positioned within said second camshaft and said second camshaft is torsionally fixably connected with said sprocket.

10. A camshaft arrangement as described in claim 8 having one said camshaft with lobes to open a valve and said other camshaft with lobes to close said same valve.

11. A camshaft arrangement as described in claim 8 having one camshaft with lobes for an exhaust valve and said other camshaft with lobes for an intake valve.

12. A camshaft arrangement as described in claim 11 wherein said second cam follower is engaged with a lobe for an intake valve.

13. A camshaft arrangement as described in claim 1 wherein said sprocket is powered by a flexible tensioned torsional force transfer member engaged with a sprocket connected with a crankshaft of an engine.

14. A reciprocating piston internal combustion engine torque pulse VCT camshaft arrangement comprising:

a sprocket;

a cam torque actuated phaser connected with said sprocket;

a first camshaft connected with said sprocket and torsionally powering said cam torque actuated phaser, said first camshaft having a plurality of lobes for opening and closing exhaust valves;

a second camshaft angularly adjustable with respect to said first camshaft via said cam torque actuated phaser and being concentric with respect to said first camshaft, said second camshaft having cam lobes for opening and closing intake valves, said intake valves being biased by a respective first spring;

a first cam follower engaged with at least one of said second camshaft cam lobes for controlling a position of one of said intake valves; and a second cam follower biased by a contacting spring separate from said respective first spring biasing said intake valves, second cam follower being engaged with at least one of said cam lobes engaged with said first cam follower for imparting torsional input to said second camshaft.

15. A torque pulse VCT camshaft arrangement comprising:

a sprocket;

a cam torque actuated phaser connected with said sprocket;

a first camshaft connected with said sprocket and torsionally powering said camshaft phaser, said first camshaft having a plurality of lobes for controlling a closing position of valves biased by respective first springs;

a second camshaft angularly adjustable with respect to said first camshaft via said cam torque actuated phaser and being concentric with respect to said first camshaft, said second camshaft having a plurality of lobes for controlling an opening position of said valves;

a first cam follower for engagement with one of said cam lobes of said second camshaft for controlling the position of at least one of said first spring biased valves; and a second cam follower engaged with at least one cam lobe of said second camshaft for imparting torsional input to said second camshaft, said second cam follower being biased by a contacting spring separate from said first spring biasing said valve.

* * * * *